US005228656A

United States Patent [19]

Sauber

[11] Patent Number: 5,228,656

[45] Date of Patent: Jul. 20, 1993

[54] REEL BAR SADDLE LATCHING DEVICE

[76] Inventor: Charles J. Sauber, 10 N. Sauber Rd., Virgil, Ill. 60182

[21] Appl. No.: 929,398

[22] Filed: Aug. 14, 1992

[51] Int. Cl.[5] ..... F16M 11/00

[52] U.S. Cl. ..... 248/201; 242/129.6

[58] Field of Search ..... 248/201, 205.1, 694, 248/121, 177; 242/86.7, 156.2, 129.6, 129.62, 68.4; 403/235

[56] References Cited

U.S. PATENT DOCUMENTS

| | | | |
|---|---|---|---|
| 1,807,356 | 5/1931 | Vance | 248/298 |
| 2,213,764 | 9/1940 | Hermann | 242/156.2 |
| 2,909,590 | 10/1959 | Stanley | 242/129.6 X |
| 4,325,522 | 4/1982 | Sauber | 242/86.7 |
| 4,494,710 | 1/1985 | Harris et al. | 242/86.7 X |
| 5,012,998 | 5/1991 | Gautier et al. | 248/201 X |

*Primary Examiner*—Ramon O. Ramirez

*Attorney, Agent, or Firm*—Leydig, Voit & Mayer

[57] ABSTRACT

A retaining pin and saddle member for supporting a shaft is provided wherein the saddle member has a Y-shaped body including a pair of spaced apart arms with a mounting means depending from the body, and a nonremovable retaining pin slidably fits through the transverse openings in the free ends of the arms. The retaining pin has a first radial guide for holding the pin in a first closed position while allowing rotational movement and interconnecting guide means for moving the pin to a second opened position. The pin has a second longitudinal guide intersecting with the interconnecting guide means which permits the pin to move longitudinally to the opened position to provide an unrestricted opening between the arms. A coacting stop means located in an arm cooperates with the first and second pin guides to preclude removal of the pin from the arm.

16 Claims, 5 Drawing Sheets

REEL BAR SADDLE LATCHING DEVICE

FIELD OF THE INVENTION

The present invention relates generally to support saddles for cylindrical shafts and more particularly to a saddle latching device for supporting the cylindrical spool shafts extending from a horizontally disposed reel assembly.

BACKGROUND OF THE INVENTION

Various types of latchable saddles for supporting and securing the shaft of a reel assembly in a horizontal disposition have been previously used in the art. One type as shown, for example, in Sauber U.S. Pat. No. 4,325,522 generally includes a "Y" shaped saddle member with a lower mounting base and spaced apart upper arms with the arms having transverse openings that receive a removable retaining pin. Such retaining pins often have a head at one end and a fastener such as a cotter pin or the like is used at the other end to secure the pin. Since pins alone may be lost after being removed from the saddle and pin assembly during installation of a new reel assembly often a chain or other tether has been provided, but they do break over time and use.

Also, such pins of the above saddle and pin assembly have difficulties and pose problems like possibly vibrating out of the assembly if the cotter pin is not properly secured, requiring tools to remove or assemble, and being cumbersome to open and close during replacement of a reel assembly.

The present invention is directed toward overcoming one or more of the problems discussed above by providing a captured pin arrangement for a support saddle which is easy to use and eliminates the potential time waste of either manipulating or pin tethering to the saddle or hunting for a lost pin.

It is another related object of the invention to provide a latching device for a saddle which avoids possible vibrating out of position during use.

A further object of the invention is to provide a latchable pin and saddle assembly that is easy to open and close without tools.

Another object of the invention is to provide a pin and saddle assembly that may be easily installed onto supports carried by a vehicle.

It is another object of the invention to provide a pin and saddle assembly that is relatively inexpensive and made up of easily replaceable components.

Other objects and advantages of the invention will be apparent from the following detailed description.

SUMMARY OF THE INVENTION

In accomplishing these and other objects of the invention, there is provided a retaining pin and saddle member for supporting a shaft. The saddle member has a "Y" shaped body and includes a pair of spaced apart arms as well as a mounting end depending from the body. A non-removable retaining pin slidably fits through transverse openings which are located adjacent the free ends of the arms. The retaining pin has a first groove which cooperates with a pin located in one of the arms for holding the pin in a first closed position straddling the arms. In this mode, the pin is restricted from longitudinal movement. The groove also provides a second open position wherein the pin extends outwardly from one of the arms. The pin also has a second groove which interacts with the pin to permit movement longitudinally to the second open position. The groove is so configured so as to preclude complete removal of the pin from the arm.

In a preferred embodiment of this aspect of the invention, the first, second and third grooves are interconnected with the first groove being a radial groove and the second groove being a longitudinal groove.

DESCRIPTION OF THE PREFERRED EMBODIMENT

While the invention will be described in connection with a particular preferred embodiment, it will be understood that it is not intended to limit the invention to that particular embodiment. On the contrary, it is intended to cover all alternatives, modifications and equivalents as may be included within the spirit and scope of the invention as defined by the appended claims.

Figure 1:
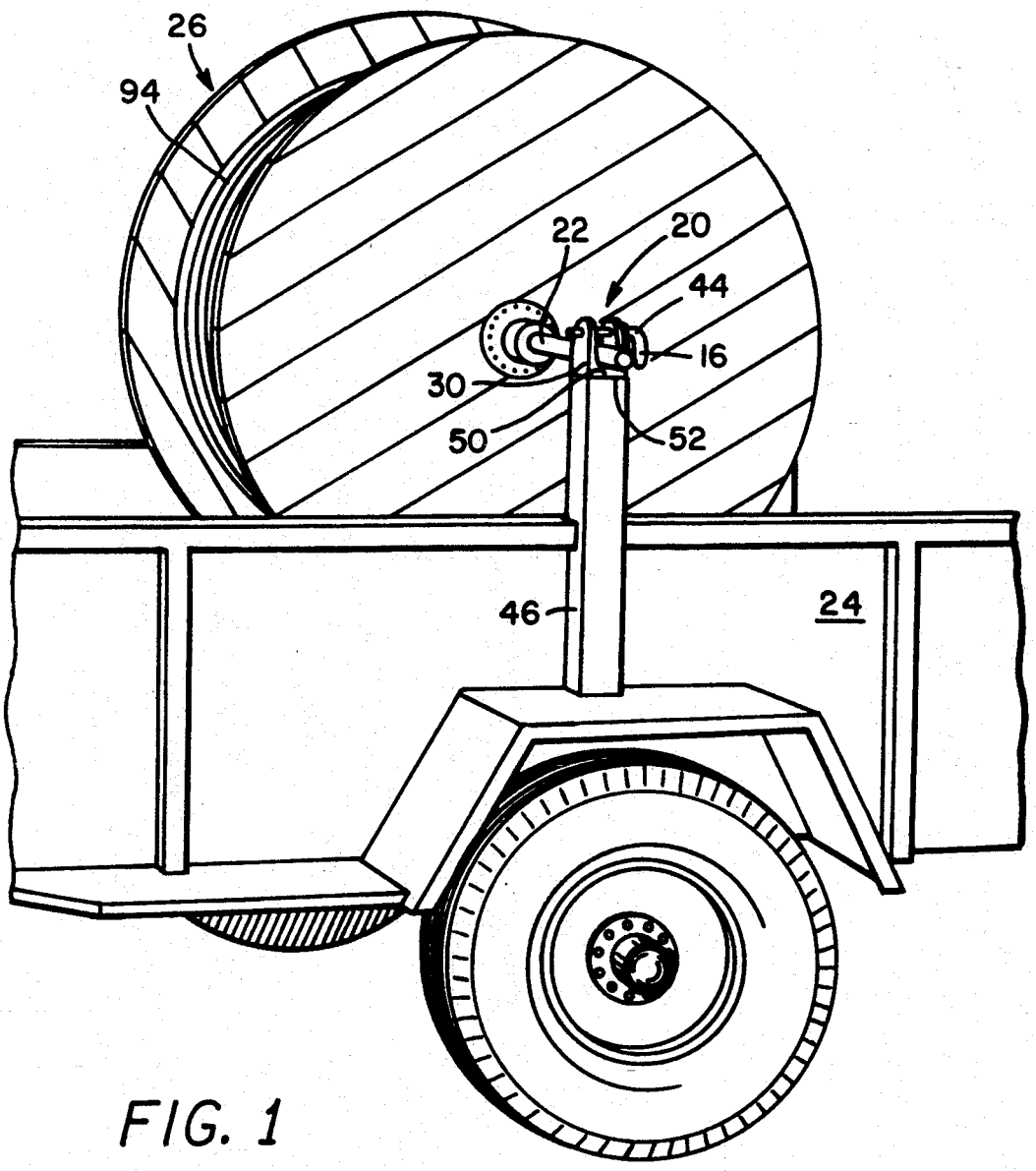
FIG. 1 is a perspective view of a reel bar saddle latching device embodying the present invention as installed on a vehicle.

Now turning the drawings, in referring first to FIG. 1, there is shown a reel bar saddle latching device 20 manufactured in accordance with the invention to secure a shaft 22 onto a vehicle 24. As is apparent from FIG. 1, two such saddle latching devices 20 are positioned on each shaft 22 in a manner which prevents axial movement of a reel assembly 26.

Figure 2:
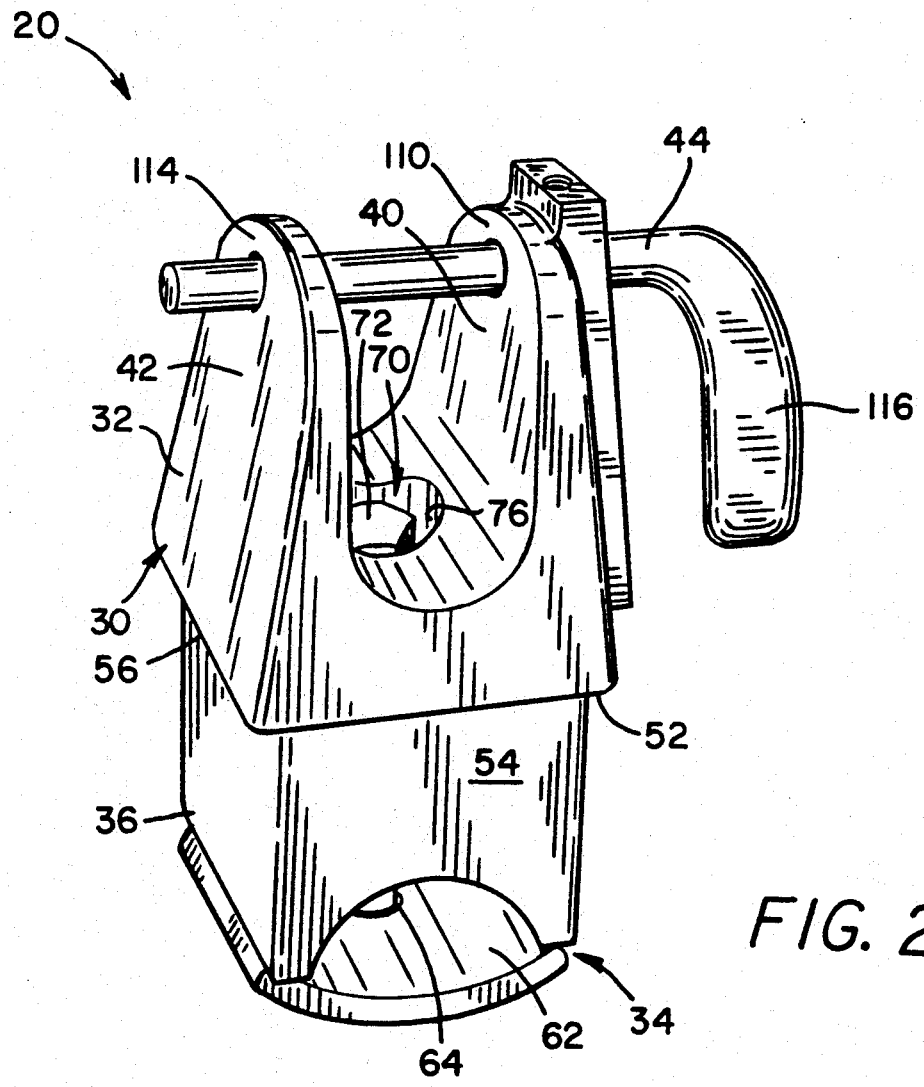
FIG. 2 is a perspective view of a reel bar saddle latching device of the present invention.

The reel bar saddle latching device 20 in accordance with the present invention, is shown in FIG. 2. The device 20 comprises a saddle member 30 which may take any suitable form, but preferably comprises the shape of a Y-shaped body 32. To secure the device 20 to the vehicle 24, mounting means 34 are located on a first end 36 of the Y-shaped body 32.

The Y-shaped body 32 also includes a upwardly extending first arm 40 for laterally securing the shaft 22 within the device 20. The arm 40 extends upwardly from the Y-shaped body 32. Also extending vertically and spaced apart from the first arm 40, is a second arm 42. To fully secure the shaft 22 to the device 20, a non-removable rotating pin means 44 extends through the first arm 40 and the second arm 42.

The pin means 44 may be made of any strong durable suitable material such as metal, but preferably it is made of bronze.

The mounting means 34 may take on any suitable means, but preferably the mounting means 34 is designed to fit within the vertical channel 46 of the vehicle 24 as shown in FIG. 1. A top face 50 of the vertical channel 46 supports a lip 52 of the Y-shaped body 32.

Again referring to FIG. 2, immediately below the lip 52 is a generally rectangularly shaped stem 54, which extends downwardly from an inner periphery 56 of the lip 52.

Figure 3:
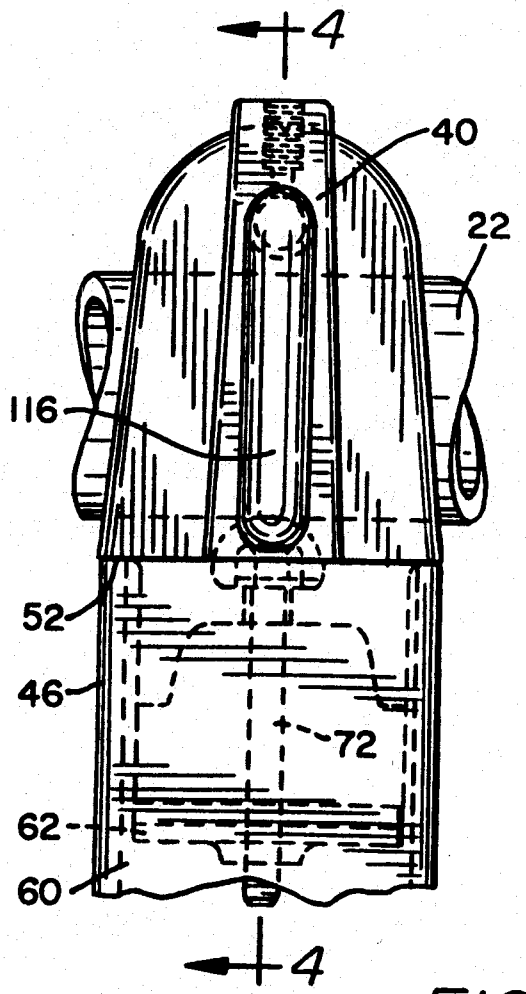
FIG. 3 is a rear plan view of the reel bar saddle latching device in the closed positioned.

In order that the member 20 may be easily assembled on to the vehicle 24, the stem 54 slidably fits into a rectangular opening 60 of the hollow vertical channel 46 as shown in FIG. 3.

Any suitable means may be utilized to secure the mounting means 34 to the hollow vertical channel 46, but preferably the mounting means 34 further comprise arcuate plate means 62 as shown in FIG. 2. The arcuate plate means 62 may have any suitable configuration but typically has a rectangular cross-section similar to the stem 54 in order that the arcuate plate means 62 when in an undeformed configuration may slidingly fit within the opening 60.

Figure 4:
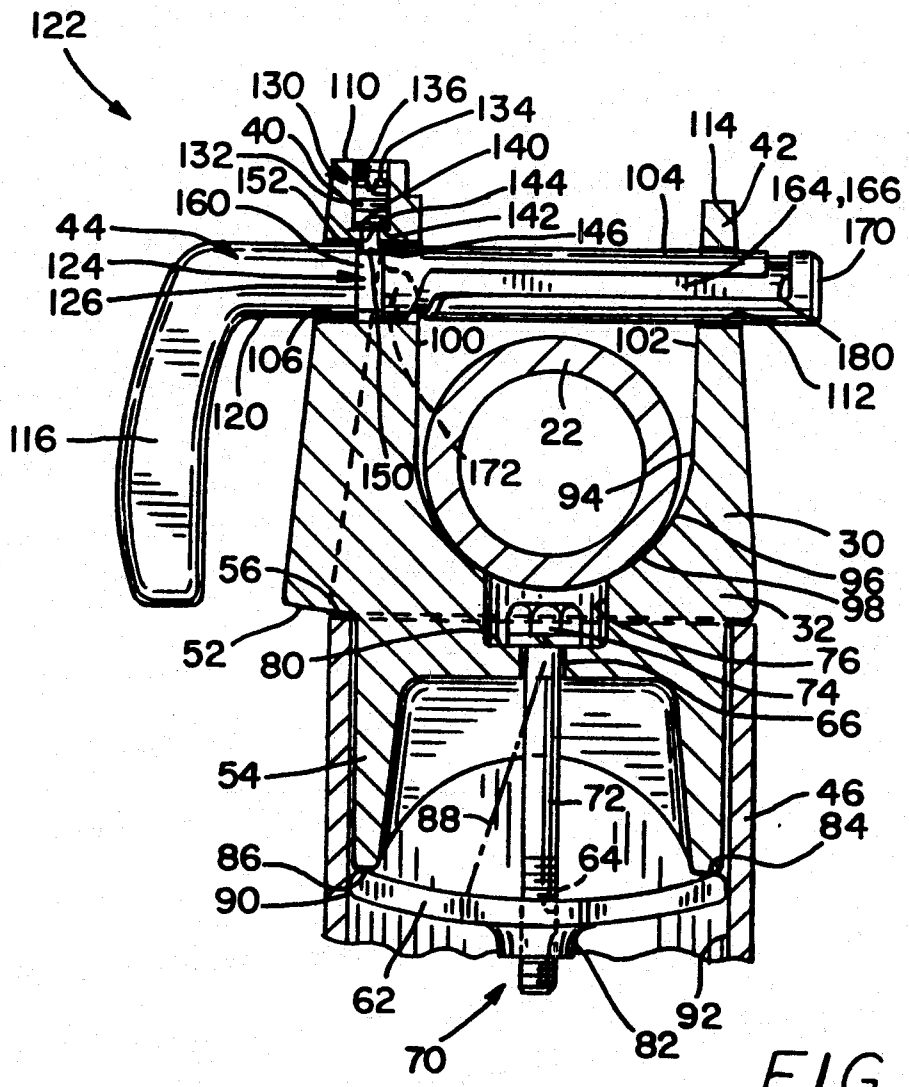
FIG. 4 is a sectional plan view of the invention taken along lines 4—4 of FIG. 3.

To secure the arcuate plate means 62 preferably to the Y-shape body 32, the arcuate plate means 62 has a centrally located transverse plate opening 64 while the Y-shape body 32 has a centrally located longitudinal body opening 66 centrally located within the stem 54 as shown in FIG. 4.

A fastener means 70 extends through the plate opening 64 and the body opening 66 and is used to secure the arcuate plate means 62 to the body 32. The fastener means 70 may take any suitable configuration, but preferably the fastener means 70 comprises a hexagonally headed cap screw 72 which fits into the body opening 66. The cap screw 72 may be any standard suitable commercially available cap screw.

In order that the cap screw 72 does not interfere with the proper seating of shaft 22 upon the saddle member 30, the cap screw 72 has a hexagonal head 74 which is recessed within a counter bore 76 located above the body opening 66. The bottom of the hexagonal head 74 seats against a body shoulder 80 in the bottom of the counter bore 76.

To secure the arcuate plate means 62 to the cap screw 72, a nut 82 is provided. Preferably the nut 82 is permanently secured to the arcuate plate member 62 so that the nut 82 does not rotate relative to the arcuate plate member 62 during installation.

To provide for the wedging effect of the arcuate plate means 62 within the hollow vertical channel 46, the arcuate plate means 62 is placed in an upwardly curving position with an outer edge 84 of the arcuate plate means 62 seated against a bottom face 86 of the stem 54. When the cap screw 72 is rotated relative to the nut 82, a radius of curvature 88 of the arcuate plate means 62 increases or flattens out. A plate periphery 90 of the arcuate plate means 62 is in interference with inner walls 92 of the hollow vertical channel 46 thereby securing the Y-shape body 32 within the channel 46.

The arcuate plate means 62 may be made of any suitable durable material with sufficient resiliency to be distorted into a less arcuate configuration.

To permit rotation of the reel assembly 26 so that a cable 94 wound about the reel assembly 26 may be removed, the shaft 22 of said reel assembly 26 is supported by and permitted to rotate freely within a saddle 96 formed in the body 32. Typically the saddle 96 has a semi-cylindrical lower portion 98 on which the shaft 22 freely rotates. To contain the shaft 22, the saddle 96 also has substantially vertical walls which are defined by first and second inner walls 100 and 102, respectively, of the first and second arms 40 and 42, respectively.

To accommodate the substantial radial load of the heavy reel assembly 26, the Y-shaped body 32 must have sufficient strength to support the reel assembly 26. The body 32 has sufficient wall thickness to accomplish the strength requirements.

The Y-shaped body 32 may be constructed of any suitable-high strength material, such as metal, but preferably, to reduce cost, the Y-shaped body 32 is made of a castable metallic material such as bronze.

The pin means 44 contains the shaft 22 within the saddle 94 and permits removal of the reel assembly 26. To provide for the removal of the shaft 22, the pin means 44 may take any suitable form but preferably has a cylindrical portion 104 which slidably fits within a first traverse opening 106 located near a free end 110 of the first arm 40 and through a second traverse opening 112 of a free end 114 of the second arm 42. The pin means 44 may thus be moved axially within the first and second traverse opening 106 and 112, respectively, to permit the removal of the shaft 22.

To assist in the axial movement of the pin means 44 relative to the first and second traverse openings 106 and 112, respectively, handle means 116 are preferably provided. The handle means 116 may take on any suitable configuration, but preferably have a slightly arcuate elongated shape whereby the handle means 116 may fit comfortably into an operators hand (not shown).

To bias the radial orientation of the cylindrical portion 104 of the pin means 44 for reasons later described, the handle means 116 extends downwardly from a first end 120 of the cylindrical portion 104 of the pin means 44 preferably and generally at a right angle to the cylindrical portion 104. The weight of the handle means 116 thereby biases the horizontical cylindrical portion 104 into a first closed position 122 as shown in FIG. 4.

To retain the pin means 44 in the first closed position 122, first guide means 124 are provided. The first guide means 124 may have any suitable configuration, but preferably the first guide means 124 comprise a circular radial groove 126 formed in the cylindrical portion 104 of the pin means 44 adjacent the handle means 116.

To assist the first guide means 124 in retaining the pin means 44 in the closed position 122, arm cooperating means 130 are located in one of the first and second arms 40 and 42, respectively, are provided. The arm cooperating means 130 are preferably located in the first arm 40. The arm cooperating means 130 may take any shape or form, but preferably comprise a stop or pin member 132 which cooperates with the radial groove 126 to retain the pin means 44.

In order that a worn or damaged pin means 44 may be easily removed from the saddle member 20 and replaced by a new pin means 44, the pin member 132 preferably comprises a dog point set screw 134. The set screw 134 is preferably threadably fitted into a longitudinal threaded bore 136 centrally located in the free end 110 of the first arm 40 and perpendicular to first transverse opening 106. At the bottom of the threaded bore 136 is a shoulder 140 to which a step face 142 of the set screw seats. A small bore 144 extends concentrically to the threaded bore 136 downwardly from the shoulder 140 and extends into the first traverse opening 106. A dog point 146 extends downwardly from the set screw step face 142 and slidably fits through the small bore 144 extending into the radial groove 126. The dog point 146 slidably fits within the groove 126 and has an outer end 150 which is clearance with a bottom 152 of the radial groove 126 in order that the pin means 44 may freely rotate within the opening 126 of the Y-shaped body 32.

Figure 6:
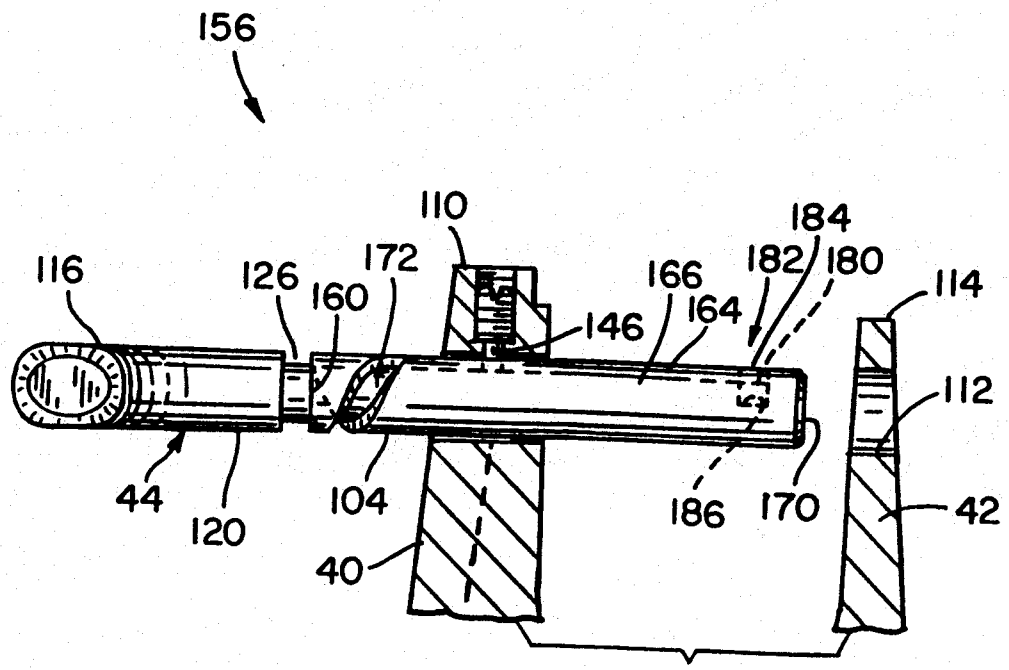
FIG. 6 is a sectional plan view taken along line 6—6 of FIG. 5.
Figure 5:
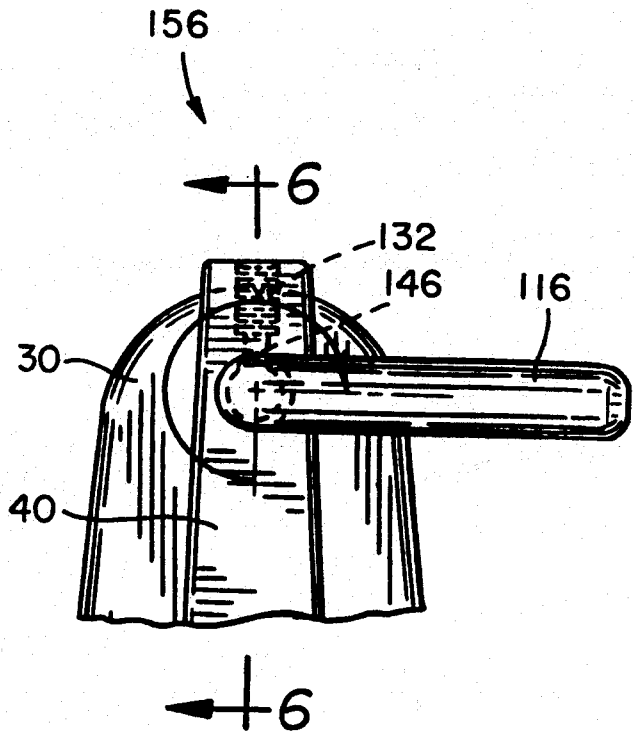
FIG. 5 is a rear plan view showing the reel bar saddle latching device in the partially opened position.
Figure 9:
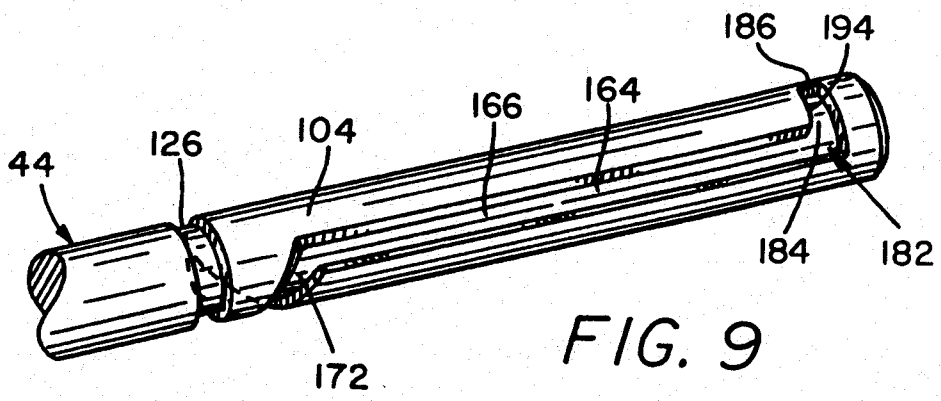
FIG. 9 is a fragmentary perspective view of the pin of the present invention showing the groove.

In order that the pin means 44 may be slid from the first closed position 122 to a partially opened position 156 as shown in FIGS. 5 and 6, the radial groove 126 has a longitudinal opening 160. The dog point 146 slidably fits within the longitudinal opening 160, and the pin means 44 moves axially from the closed position 122 to the partially opened position 156.

In order that the pin means 44 remain in the first closed position 122, the longitudinal opening 160 is positioned in the cylindrical portion 104 of the pin means 44 at an angle substantially different than 180 degrees from the handle means 116. Since gravity maintains the handle means 116 in a downward position and since the dog point 146 is located on the free end 110 of the first arm 40, at an upward position at approximately 180 degrees from downward position of the handle means 116, the longitudinal opening 160 is not aligned with the dog point 146. The dog point 146 cooperating with the radial groove 126 thereby prevents the handle means 116 from deviating from its closed first position 122. The handle means 116 can thereby be kept in the closed first position 122 without the assistance of fasteners such as pins or nuts which may be lost and require tools for assembly.

Figure 8:
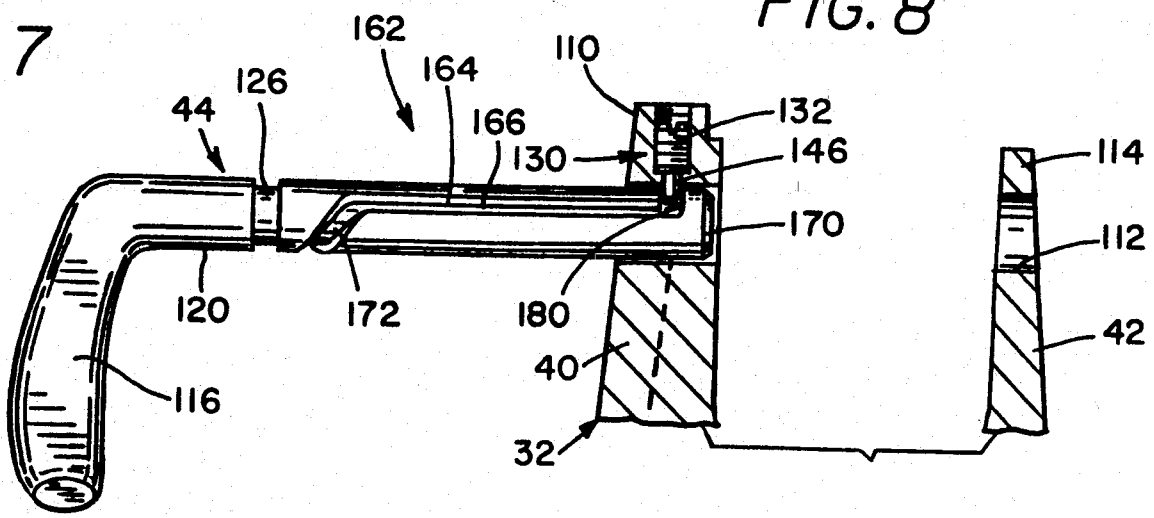
FIG. 8 is a sectional plan view taken along line 8—8 of FIG. 7.
Figure 7:
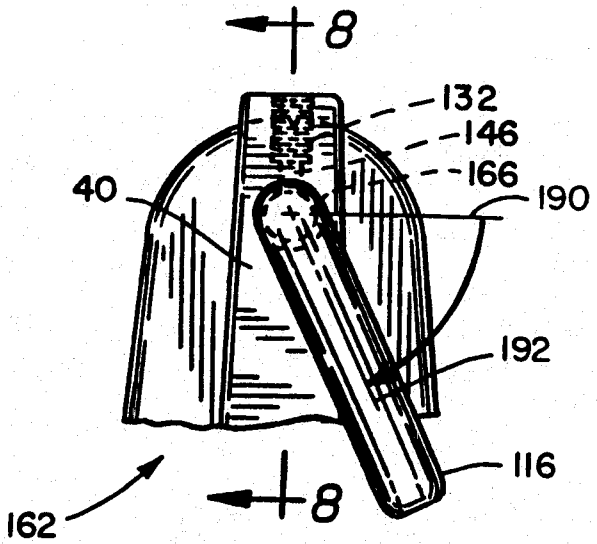
FIG. 7 is a rear plan view illustrating the reel bar saddle latching device in the opened position.

To allow the pin means 44 to be moved from its first closed position 122 to an unrestricted fully opened position 162 as shown in FIGS. 7 and 8, second guide means 164 as shown in FIG. 4 are provided. The second guide means 164 cooperate with the arm cooperating means 130 to provide the unrestricted fully open position 162.

The second guide means 164 may have any suitable form but preferably comprise a longitudinal groove 166 which extends from the radial groove 126 to a position near a second end 170 of the pin means 44 opposite the handle means 116. The dog point 146 of the set screw 134 of the arm cooperating means 130 slidably fits within the longitudinal groove 166 thereby permitting the axial movement of the pin means 44 to the fully opened position 162.

To prevent unwanted opening of the pin means 44 while providing means for moving the pin means 44 from the first closed position 122 to the fully opened position 162, a spiral groove 172 is preferably provided. The spiral groove 172 interconnects the radial groove 126 at the longitudinal opening 160 to the longitudinal groove 166. While providing the longitudinal opening 160 at a position other than opposite the handle means 116, may somewhat reduce the occurance of the pin means 44 vibrating and jostling from the first closed position 122 to the open position 162, a combination of having the first end 120 of the pin means 44 lower than the second end 170 and of rocking the handle means 116 during transport of the vehicle may align the dog point 146 with the longitudinal opening 160 resulting in the opening of the pin means 44. By the use of a spiral groove 172, a much greater angular rotation of the handle means 166 is required to move the pin means 44 from a position where the dog point 146 is in the radial groove 172 to a position where the dog point 146 is in the longitudinal groove 166. Preferably, as shown in FIG. 5, the handle means 116 must be rotated clockwise 270 degrees before the dog point 146 is aligned with the longitudinal groove 166. A required rotation of over 180 degrees would not be possible without the inclusion of the spiral groove 172.

Referring to FIG. 6, once the handle means 116 is rotated 270 degrees from the first closed position 122 while the handle means 116 is also pulled axially from the first arm 40, dog point 146 aligns with the longitudinal groove 166 and the handle means 116 is further pulled outwardly from the first arm 40 until the second end 170 of the pin means 44 is located within the first transverse opening 106 providing the fully opened position 162 as shown in FIG. 8.

In order that the pin means 44 is not lost during the movement of the pin means 44 from the first closed position 122 to the fully opened position 162 and in order that reel assembly 26 may be replaced, the pin means 44 is not removable during normal operation of the retaining pin and saddle member 20. The non-removable feature of the retaining pin means 44, may be accomplished in any suitable manner to fall within the scope and spirit of the invention, but preferably the non-removable feature is accomplished by providing the longitudinal groove 166 with a longitudinal groove shoulder 180 near the second end 170 of pin means 44 whereby the longitudinal groove 166 does not extend through the second end 170 of the pin mean 44. When the pin means 44 is in the fully opened position 162 as shown in FIG. 8, the dog point 146 of the set screw 134 seats against the longitudinal groove shoulder 180 of the pin means 44 thereby preventing the removal of the pin means 44 from the Y-shaped body 32.

During installation of a new reel assembly 26 the pin means 44 may become dislodged from its fully open position 162 into the partially opened position 156 as shown in FIG. 6. The pin means 44 may be bent or broken when the shaft 22 of the very heavy reel assembly 26 is dropped upon the second end 170 of the pin means 44 in the partially opened position 156. To prevent this damage to the pin means 44 third guide means 182 may be provided for latching the pin means 44 in the fully opened position 162. While the third guide means 182 may take any suitable form, preferably the third guide means 182 comprise a second radial groove 184 which has a blind end 186. The second radial groove 184 extends radially from the longitudinal groove 166 near the second end 170 of the pin means 44.

The radial groove 126, longitudinal groove 166, the spiral groove 172 and the second radial groove 184 may be incorporated into the pin means 44 in any suitable fashion, such as machining, but to minimize cost, preferably is cast into the pin means 44.

Referring to FIG. 7, the handle means 116 is rotated from a right horizontal position 190 at which the dog point 146 is aligned with the longitudinal groove 166 clockwise to a second position 192 in which the dog point 146 seats against the blind end 186 of the second radial groove 184 as shown in FIG. 8.

Referring to FIG. 7 and 8, when the dog point 146 is seated against the blind end 186, the handle means 116 is in a generally downward position whereby gravity maintains this particular position of the handle means 116. Also, an inner shoulder 194 of the second radial groove 184 interferes with dog point 146 to prevent the pin means 44 from moving from the fully open position 162.

As can be seen from the foregoing detailed description, by providing channels in the pin which cooperates with a pin member trapping the pin within the Y-shaped body, loss of the pin is avoided.

As will be appreciated by those skilled in the art, by providing a groove in the pin which cooperates with a pin member, the need for tools to open and close the pin assembly is eliminated.

The provision of ample clearance between the pin and the openings in the Y-shape body as well as between the pin member and the grooves, avoids jamming of the pin within the body.

Since the arcuate plate slidably fits into the channel and is easily distorted by a simple tightening of a fastener, the retainer and saddle member may be easily installed and replaced.

Various features of the grooved pin arrangement of the present invention provide benefits not previously obtainable with prior arrangements, such as, the following:

a first radial groove in the pin which cooperates with the pin member which reduces dislodging of the pin in use;

a spiral groove between the axial groove and longitudinal groove which avoids dislodging of the pin during operating of the vehicle under severe conditions in which the vehicle is transported across rough terrain; and a second radial groove with a blind end which thereby locks the pin in an open position avoiding damage to the pin during reel replacement.

The retaining pin and saddle member easily opens and closes by providing ample clearence between the dog point and the channels in the pin member and the transverse openings and the pin, An inexpensive retaining pin and saddle assembly is possible by providing a cast pin and a cast Y-shaped body which minimizes costly machining.

Providing a threadably removable set screw eases replacement of the pin.

Improper assembly of the set screw is avoided by providing a dog point set screw having a step face which seats against a shoulder.

Still other aspects, object and advantages of the present invention can be obtained from the study of the specification, the drawings and the appended claims.

I claim:

1. A retaining pin and saddle member for supporting a shaft, comprising:

said saddle member having a substantially Y-shaped body including a pair of spaced apart arms and mounting means depending from said body;

non-removable retaining pin means slidably fit through transverse openings adjacent the free ends of said arms;

said retaining pin means having first guide means associated with one of said arms for holding said pin means in a first closed position straddling said arms and restricted from longitudinal movement and a second open position wherein said pin means is outwardly extending;

said pin means having a second guide means associated with said one of the arms for permitting the pin means to move longitudinally to the second open position so as to provide an unrestricted opening between said arms; and, arm cooperating means carried by said one of the arms co-acting with said first and second pin guide means so as to preclude complete removal of the pin means from said arm.

2. A retaining pin and saddle member as claimed in claim 1, including third guide means on said pin at the end of said second guide means for latching said pin means at its outwardly extended position.

3. A retaining pin and saddle member as claimed in claim 2, wherein said first, second and third guide means in said pin are interconnected.

4. A retaining pin and saddle member as claimed in claim 3, wherein said first guide means is a radial groove and said second guide means is a longitudinal groove.

5. A retaining pin and saddle member as claimed in claim 4, wherein said radial groove and longitudinal groove are interconnected by a spiral groove.

6. A retaining pin and saddle member as claimed in claim 4, wherein said third guide means is a transverse groove interconnecting said longitudinal groove.

7. A retaining pin and saddle member as claimed in claim 4, wherein said longitudinal groove has a blind end.

8. A retaining pin and saddle member as claimed in claim 1, wherein said arm co-acting means is a pin member cooperating with said grooves.

9. A retaining pin as claimed in claim 8, wherein the pin member is a set screw.

10. A retaining pin and saddle member as claimed in claim 1, wherein said retaining pin includes a handle means adjacent the first guide means end.

11. A retaining pin and saddle member as claimed in claim 1, wherein said mounting means comprise arcuate plate means slidably fit into said support member and fastener means for flattening said plate thereby creating an interference fit between said arcuate plate means and the second member for restraining said saddle member to the support member.

12. A retaining pin and saddle member as claimed in claim 1, wherein said body is made of bronze.

13. A retaining pin and saddle member as claimed in claim 1, wherein said pin means are made of bronze.

14. A retaining pin and saddle member as claimed in claim 1, wherein said radial groove and cooperative pin means allows the retaining pin to rotate in the arms straddling position.

15. A retaining pin and saddle member as claimed in claim 1, wherein rotatable manipulation allows the arm cooperating pin means to enter the spiral interconnecting groove means and then the longitudinal means to slide the retaining pin from the arm straddling position to the outwardly extended position.

16. A retaining pin and saddle member for supporting a shaft, comprising:

said saddle member having a substantially Y-shaped body including a pair of spaced apart arms and mounting means depending from said body;

non-removable retaining pin means slidably fit through transverse openings adjacent the free ends of said arms;

said retaining pin means having a radial groove associated with one of said arms for holding said pin means in a first closed position straddling said arms and restricted from longitudinal movement and a second open position wherein said pin means is outwardly extending;

said pin means having a longitudinal groove associated with said one of the arms for permitting the pin means to move longitudinally to the second open position so as to provide an unrestricted opening between said arms;

said pin means having a spiral groove interconnecting said radial groove and said longitudinal groove; and arm cooperating means carried by said one of the arms co-acting with said grooves so as to preclude complete removal of the pin means from said arm, wherein rotatable manipulation allows the arm cooperating pin means to enter the spiral interconnecting groove means and then the longitudinal groove to slide the retaining pin from the arm straddling position to the outwardly extended position.

* * * * *